US007372945B2

(12) United States Patent
Geisser et al.

(10) Patent No.: US 7,372,945 B2
(45) Date of Patent: May 13, 2008

(54) METHOD AND DEVICE FOR THE RECORDING OF OBJECTS

(75) Inventors: Albert Geisser, Lucerne (CH); Bruno Rudolf Kezmann, Steinhausen (CH)

(73) Assignee: Tecnostore AG, Lucerne (CH)

( * ) Notice: Subject to any disclaimer, the term of this patent is extended or adjusted under 35 U.S.C. 154(b) by 101 days.

(21) Appl. No.: 10/496,038

(22) PCT Filed: Nov. 15, 2002

(86) PCT No.: PCT/IB02/04765

§ 371 (c)(1),
(2), (4) Date: Sep. 7, 2004

(87) PCT Pub. No.: WO03/044807

PCT Pub. Date: May 30, 2003

(65) Prior Publication Data

US 2005/0008122 A1 Jan. 13, 2005

(30) Foreign Application Priority Data

Nov. 22, 2001 (EP) ..... 01127371

(51) Int. Cl.
*G21K 5/10* (2006.01)

(52) U.S. Cl. ..... 378/146; 378/151; 378/152

(58) Field of Classification Search ..... 378/62, 378/63, 21, 146–152
See application file for complete search history.

(56) References Cited

U.S. PATENT DOCUMENTS 4,122,350 A 10/1978 Lipthay et al.
4,603,427 A 7/1986 Alpern et al.
4,672,652 A 6/1987 Huettenrauch et al.
5,224,136 A 6/1993 Toth et al.
5,349,625 A * 9/1994 Born et al. ..... 378/95
5,627,869 A 5/1997 Andrew et al.
5,818,902 A * 10/1998 Yu ..... 378/65
6,055,295 A * 4/2000 Murthy et al. ..... 378/151
6,502,984 B2 * 1/2003 Ogura et al. ..... 378/206
2001/0048732 A1 * 12/2001 Wilson et al. ..... 378/21
2006/0182221 A1 * 8/2006 Bernhardt et al. ..... 378/106

FOREIGN PATENT DOCUMENTS

EP 0 223 432 A 5/1987

OTHER PUBLICATIONS

Derwent Publication AN-1987-K9819A XP 002196119 & SU 591 239A Jan. 20, 1987 Abstract.

* cited by examiner

*Primary Examiner*—Jurie Yun
(74) *Attorney, Agent, or Firm*—Ohlandt, Greeley, Ruggiero & Perle, LLP; George W. Rauchfuss, Jr.

(57) ABSTRACT

The invention relates to the recording of an object (4) by imaging with a radiation source (2) on a recording medium (3) using aperture (6), the size of which may be adjusted using adjusting means (7), depending on the size of said object. Sensors (8) are provided for determination of object size. The quality of the images, which are in particular X-ray images, can thus be improved.

19 Claims, 4 Drawing Sheets

METHOD AND DEVICE FOR THE RECORDING OF OBJECTS

CROSS REFERENCES TO RELATED APPLICATIONS

This application claims the priority of the European patent application No. 01 127 371.1 of 22 Nov. 2001, the disclosure of which is incorporated herein by reference in its entirety.

TECHNICAL FIELD

The invention relates to a method as well as a device, respectively, according to the preamble of the.

BACKGROUND ART

In photo technique moving apertures (shutter, shutter apertures) for the dosage of the amount of light are known, whereby e.g. the breadth of the aperture for the variation of the amount of light can be differently adjusted.

In radiology, apertures are known as collimators which serve with constant dimensions for the reduction of the produced radiation dosage, but which, according to U.S. Pat. No. 4,773,087, also are used for the reduction of scattered radiation. Furthermore, collimators can be adjustable in order to, adjusted to the object to be recorded, limit the radiated area. In this way, it is shown in U.S. Pat. No. 4,122,350 a size-adjustable collimator for the limitation of the area impinged by rays in mammography, whereby no relative movement between the object and radiation source occurs. From U.S. Pat. No. 4,603,427, an adjustable collimator is known by means of which the height of the irradiated area can be limited in connection with cephalometric panorama photos. The breadth of the section of the ray beam and the slewing plane is determined by a non-adjustable slit at the exit of the radiation source. Perpendicular to the slewing plane, the ray beam is limited by the height-adjustable collimator, whereby signaling rods show the limitation of the height. From U.S. Pat. No. 3,518,435, an adjustable collimator is known, which limits the irradiated area depending on the film cassette size used. In connection with the type of recording shown, no relative movement between the object and the radiation source occurs. In general, it is known in radiology to use collimators for the limitation of the irradiated area and, prior to the real recording, to display the limited area for the control thereof on the object (patient) by means of visible light. Furthermore, collimators for the limitation of the X-rays are used when using line detectors such that the radiosensitive line detector is exclusively irradiated. In classic photographic radiology, radiation grids are also used for the reduction of the scattered radiation. However, this method for the reduction of scattered radiation also weakens simultaneously the wanted radiation so that, for the production of a high-contrast image, high dosages of X-rays have to applied. These radiation grids, which are between the object and the image, are constant in their dimensions. The absorption of undesired scattered radiation by the recording means during the image recording generally leads to a declined wanted signal/unwanted signal ratio and thus not to an optimal image quality.

DESCRIPTION OF THE INVENTION

It is the object of the present invention to improve the image quality.

In connection with a method of the type mentioned above, this is achieved by means of the characterizing features of the method claims. In connection with a device mentioned above, this is achieved by means of the characterizing features of the method claims.

Since an aperture with a focal aperture that is dependent on the object size, is used, the scattered radiation can be especially well reduced and that increases the image quality. It appears that, in particular in connection with X-ray photography, that the aperture, which is dependent on the object size, leads to more sharply-defined images which allow a better interpretation of the image of the object.

Preferably, the method is used for the recording of radiographs. Preferably, it also provides a device for the determination of the object size which controls the adjustment of the aperture opening.

A further object of the invention is also to improve recordings by means of sound waves. In connection with a method or a device, respectively, of the type mentioned above, this is achieved by means of the characterizing portion of certain claims.

Also in connection with recordings by means of sound waves, an improvement of the record quality can be achieved by means of the aperture size which is adjusted depending on the object.

BRIEF DESCRIPTION OF THE DRAWINGS

In the following, embodiments of the invention are explained by means of the description and the drawings in which.

BEST MODE FOR CARRYING OUT THE INVENTION

Figure 1:
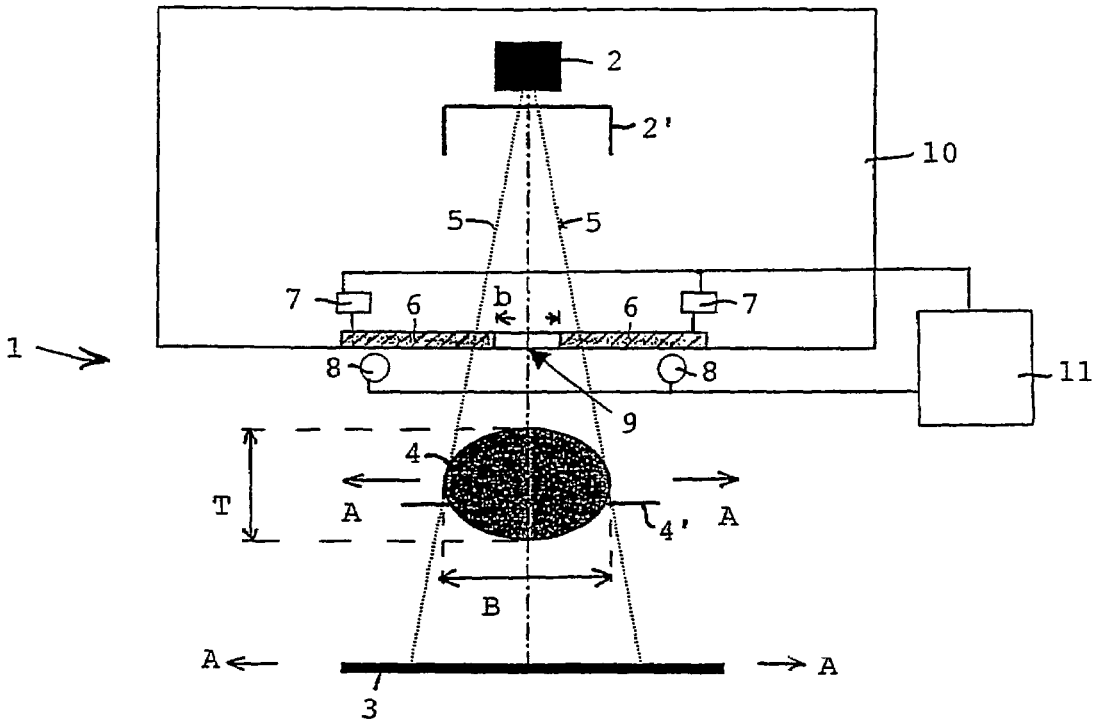
FIG. 1 is a schematic view of the inventive procedure or a device, respectively, in order to x-ray an object.

Scattered radiation, which e.g. always arises in connection with the imaging of objects by means of light waves or X-rays, is contrast decreasing regarding the image since it reduces the desired optimal contour sharpness of the object. Scattered light is produced in connection with imaging of objects by means of object-related reflections or by means of ionizing radiation which penetrates the object. Diffuse contours, which are produced accordingly, are the reasons for the worse contrast of the imaging of the object and can lead to undetermined conclusions when analyzing the imaging since, because of lack of significance of the imaging, a reliable statement about the object is made impossible. FIG. 1 shows a first embodiment in ground view having an aperture, which is adjusted depending on the object, by means of which the scattered light is reduced. Adjusted depending on the object means thereby that the object size, actually the volume of the object, but in a simplified manner also only the area of the object which is turned towards the radiation, or even only one dimension of this area, is taken into account in order to proportionally adjust the aperture to this object size, which aperture only let pass a part of the radiation which is emitted by the radiation source in a direction to the object (with or without the collimator). Thereby, FIG. 1 shows schematically a device 1 by means of which an object 4 is x-rayed in order to produce an imaging of the object 4 onto a recording means 3. Thereby, the device 1 is e.g. an industrial or medical X-ray equipment which x-rays a technical object 4 or a patient and produces the image onto an X-ray film or an X-ray plate. Accordingly, the radiation source 2 is an X-ray tube. For the object, it is provided a known object carrier 4' which is only suggested by means of two lines lateral to the object. However, if the object 4 is transparent, the radiation source 2 could also be a light source, which produces an image onto a photographic film 3. The radiation source 2, which is arranged in a schematically illustrated container, produces X-rays which form a cone contour or, if need be, differently shaped contour is suggested in the FIG. by means of boundary lines 5. Thereby, the radiation source 2 is e.g. in a container 10, which is closed vis-á-vis the object 4 by means of the aperture 6. The aperture can also be arranged separately, independent of the container. The aperture 6 comprises an opening 9 through which a part of the x-rays can exit the container 10 through the focal aperture, while the rest of the X-rays is barred from the exit of the container by means of the aperture 6. In the illustrated example, the object is arranged such that it can be met by the entire X-ray cone as it exits the source 2 and is suggested by means of the line 5. The radiation which exits the source 2 can be limited in a known manner by means of a collimator 2' which is only suggested; in this case, the line 5 represent the radiation which is already limited, which also can only extend along a part of the object 4 if only this part should be imaged or only this part is moved relative to the ray, respectively. In connection with the arrangement of FIG. 1 it is assumed that the container 10 with the source 2 and the aperture 6 is stationary whereas the object 4 as well as the recording mean 3 pass by between the aperture 6 and the recording means 3 in direction of the arrow A. The opening 9 of the aperture 6, which is illustrated in cross-section, is thereby adjusted depending on the size of the object 4, in any case, on the aperture dimension which corresponds to the movement direction. In the present case, the breadth b of the focal opening 9 which is in direction of the movement (arrow A) is adjusted. This is schematically illustrated in FIG. 1 by means of two sensor 8, which measure the object 4, e.g. contact-fre by means of an ultrasonic measuring or an optic measuring. Sensors can also be provided which contact the object in order to record its dimension for the aperture adjustment. This measuring preferably occurs prior to the image record in a separate step. According to the measuring data, the size of the focal aperture 9 is determined by a control equipment 11 and adjusted by e.g. a servo motor 7 which is operated by a control equipment 11. An interesting dimension in connection with the recording situation of FIG. 1 is the breadth B of the object which is traversed by means of the relative movement in direction of the arrow A. According to this breadth B, the breadth b of the slit-shaped focal aperture of the aperture 6 is adjusted which is slit-shaped in the present example. Thereby, the breadth b of the focal aperture is selected x-times smaller than the breadth B of the object, whereby x is in the range of 10 to 100,000, so that the slit breadth is 10 times to 100,000 times smaller than the breadth B of the object. In case of a ray which is already limited by means of collimation or a differently arranged object of which only a part is imaged, the focal aperture can also be selected as proportional to the breadth B of the part of the object. Furthermore, the height of the slit opening of the aperture 6 is preferably also adjusted according to the height of the object 4, i.e. the extension perpendicular to the drawing plane of the object 4. For this, e.g. the same divider can be used as in case of the adjustment of the breadth so that the height of the slit is also 10 times smaller to 100,000 times smaller than the height of the object 4. Then, the object 4 is imaged accordingly by means of an X-ray which is limited by the aperture which is adjusted according to the object size, whereby for this, the object and the imaging means or the X-ray plate 3, respectively, are passed by together several times along the resting and screened off radiation source 2, each time correspondingly shifted in height so that the imaging is produced stripe by stripe. As mentioned, it has appeared that, by means of a corresponding adjustment of the aperture 6 according to the proportion of the object size, an especially good reduction of the scattered light and thus an increase of the imaging quality is achievable.

Figure 2:
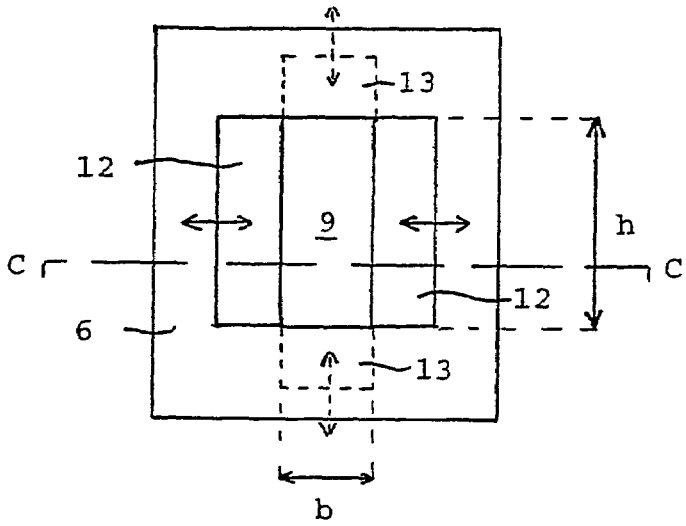
FIG. 2 is a schematic top view onto the aperture of FIG. 1.
Figure 3:
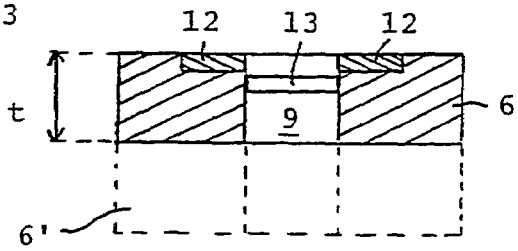
FIG. 3 is a cross sectional view along the line A-A of FIG. 2 as well as a variant of the aperture.

FIG. 2 shows a schematic a view of the aperture 6, whereby, according to FIG. 1, it is a slit aperture with a slit 9. This slit 9 can be adjusted in its height h and its breadth b by means of movable aperture element 12 and 13, which are movable relative to each other. This occurs by means of the operation means suggested in FIG. 1 which can be motor, pneumatic or hydraulic operation means. Accordingly, FIG. 3 shows a sectional view through the aperture 6 of FIG. 2, whereby equal elements are designated by equal reference numbers. The aperture can also be differently adjustable in its depth t, wherefore for this reason, the depth T of the object preferably is also measured. Thereby, an adjustment of the depth can be achieved such that several of the apertures are arranged in series as this is shown in FIG. 3 with a further aperture 6' which is only suggested.

The inventive application of the aperture for the reduction of the scattered radiation is possible for the entire spectrum of the electromagnetic radiation. The smaller the object to be imaged, the smaller should be the aperture, whereby the ratio of the proportions (aperture to object) can be as mentioned from 1:10 to 1:100,000. In order to achieve a scattered radiation reduction which is as good as possible, it is preferred a proportionality which is as high as possible, e.g. between 1:10,000 to 1:100,000. For this, e.g. the breadth of the opening of the aperture in the micrometer range is desirable. In particular in connection with very small objects, e.g. smaller than 1 mm, the optimal ratio aperture: object can only be achieved with a technical complex solution, e.g. focal aperture in the range of e.g 10 to 100 micrometers. In this case it shifted again to a lower proportionality, e.g 1:10 or 1:50.

Figure 4:
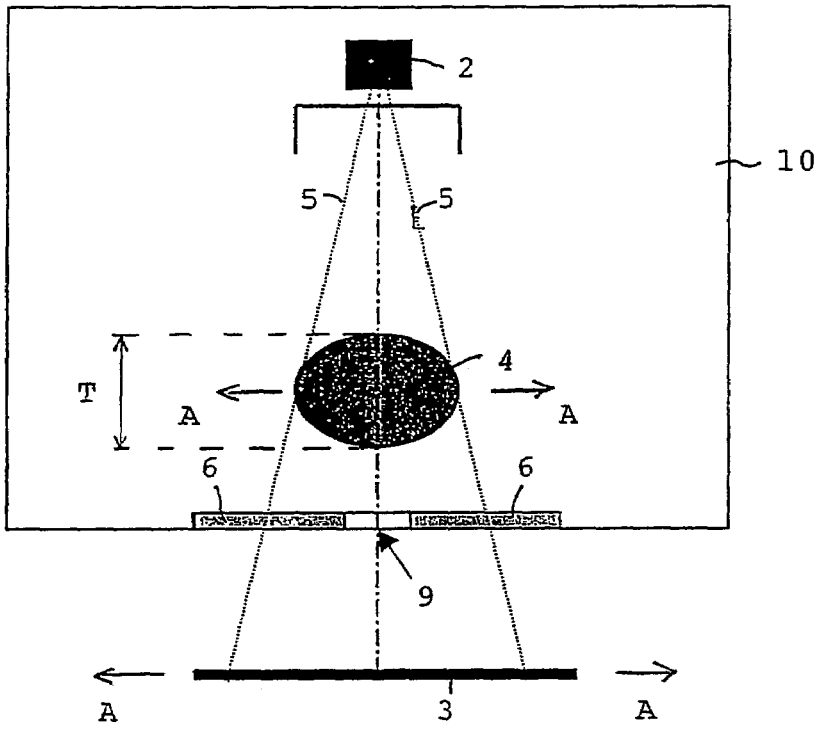
FIG. 4 is a schematic view of a modification of the procedure or the device, respectively, of FIG. 1.

FIG. 4 shows a further embodiment of the invention, whereby the same reference numbers as used in the previous Figures designate the same elements. In connection with this embodiment, the aperture, which is also shown in cross-section, is arranged between the object 4 and the recording means 3. Thereby, the object 4 and the recording means 3 are again passed by the stationary aperture 6 and the stationary radiation source according to the arrow A. According to the height h of the slit and the several fold bigger height of the object 4, the passing-by-movement happens several times with shifted height positions of the aperture and the object. For the simplification of the Figure, means 7, 8 and 11 are not shown, but are also present in connection with the device. According to the invention, anyway, the dimension of the aperture is also adjusted in this case, which corresponds to the relative movement, whereby in the present case, the breadth b is again proportional to the breadth of the object 4. The ray exits the source 2, if need be, through a collimator.

Figure 5:
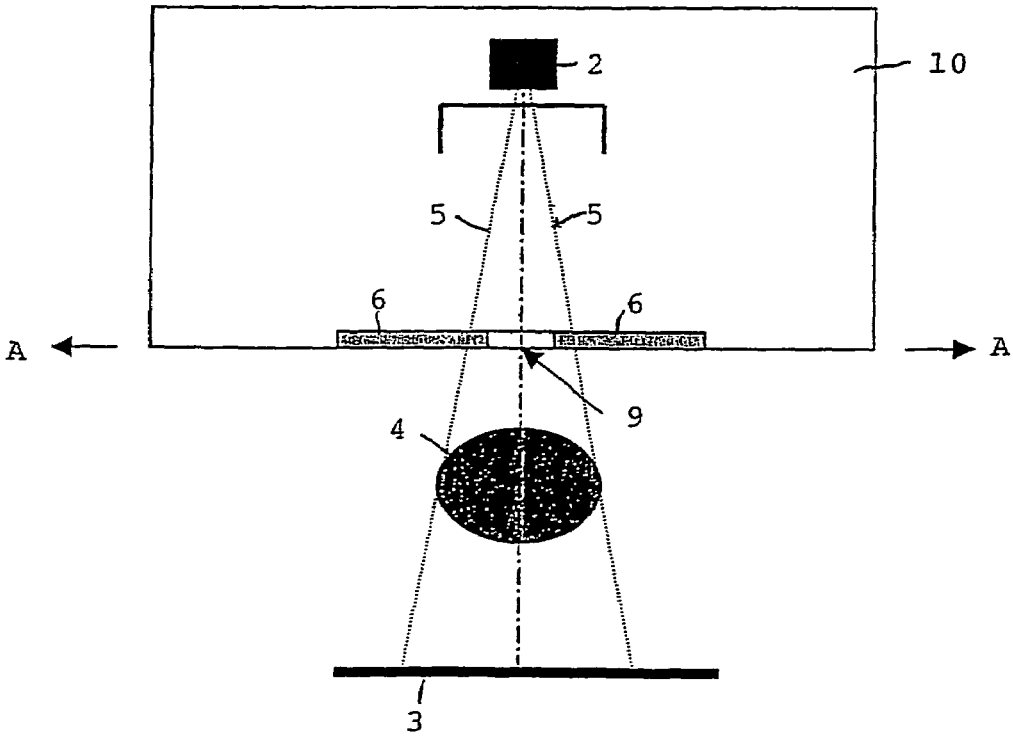
FIG. 5 is a further embodiment.
Figure 6:
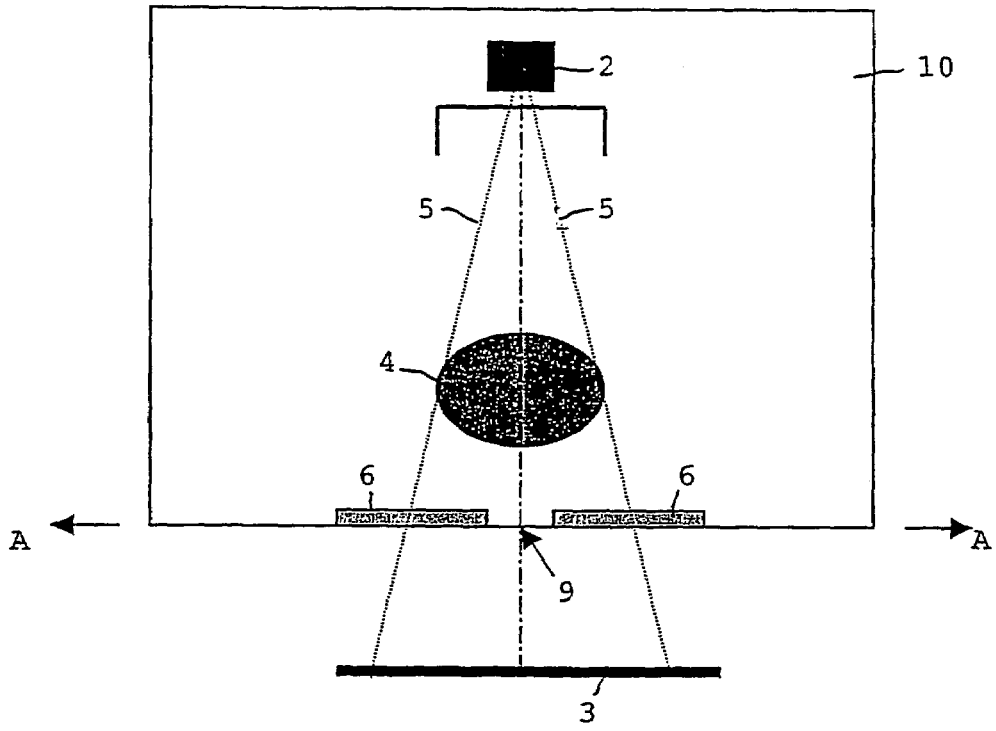
FIG. 6 is a further embodiment of the aperture.

FIG. 5 shows a further embodiment in connection with which the same elements are designated again with the same reference numbers and means 7, 8 and 11 are not shown, whereby the radiation source 2 and the aperture 6 are passed by the resting object and the resting imaging means 3 according to the arrow A. Also in this case, the image can be produced line by line onto the recording means 3 according to the height of the slit of the aperture 6. FIG. 6 shows a corresponding embodiment, whereby the aperture is arranged between the object 4 and the recording means 3. Also the apertures of FIGS. 5 and 6 are each adjusted in their slit breadth b according to the direction of the pass by of the aperture.

Figure 7:
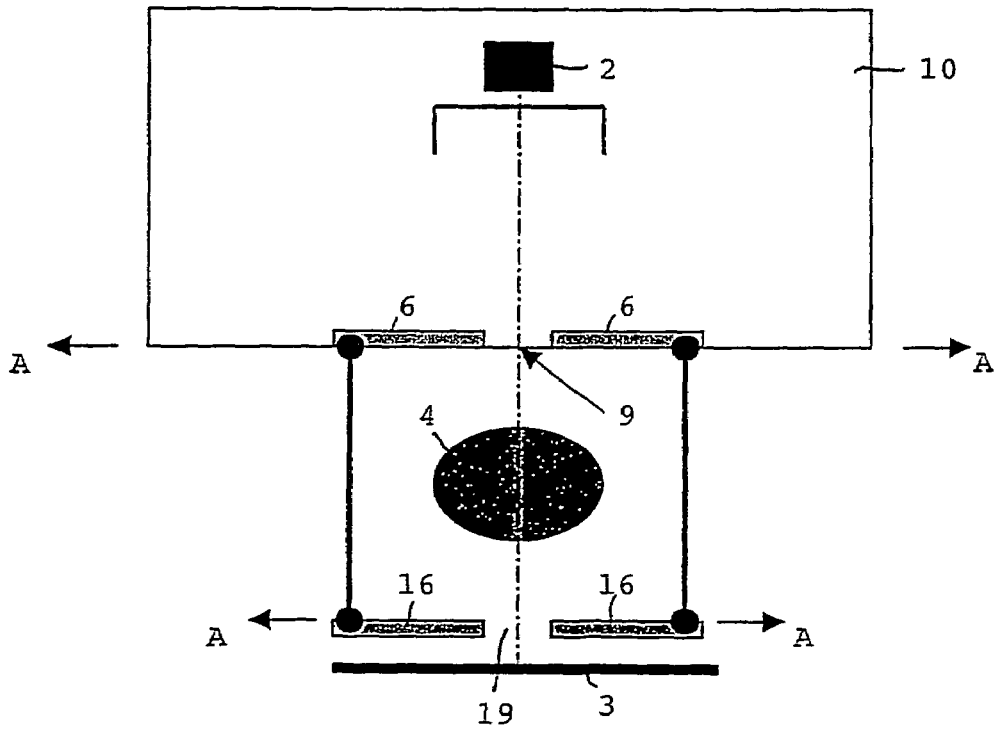
FIG. 7 is an embodiment with two apertures.

FIG. 7 shows a further embodiment, whereby two apertures 6 and 16 with the openings 9 and 19 are provided, whereby one aperture is provided between the radiation source and the object and the other aperture between the object and the imaging means 3. Thereby, the apertures are moved synchronously with the radiation source 2 in order to scan the object line by line. Thereby, the focal opening 9 is adjusted again in its breadth b depending on the object, preferably, this also occurs in connection with the focal aperture 19.

A preferred application of the invention lies in the medical X-ray technique and in the industrial X-ray technique for the checking of the materials.

Another embodiment which is not shown in the Figures is that the object is illuminated by means of visible light and a record of this object is produced onto a recording means, e.g. a photographic film. Also in this case, the image quality can be improved by means of the provision of an object-related size-adjusted aperture. The aperture, which is adjusted in its size depending on the object, can thereby undertake at the same time the function of a shutter, whereby the shutter speed is determined e.g. by means of the movement speed of the aperture.

Figure 8:
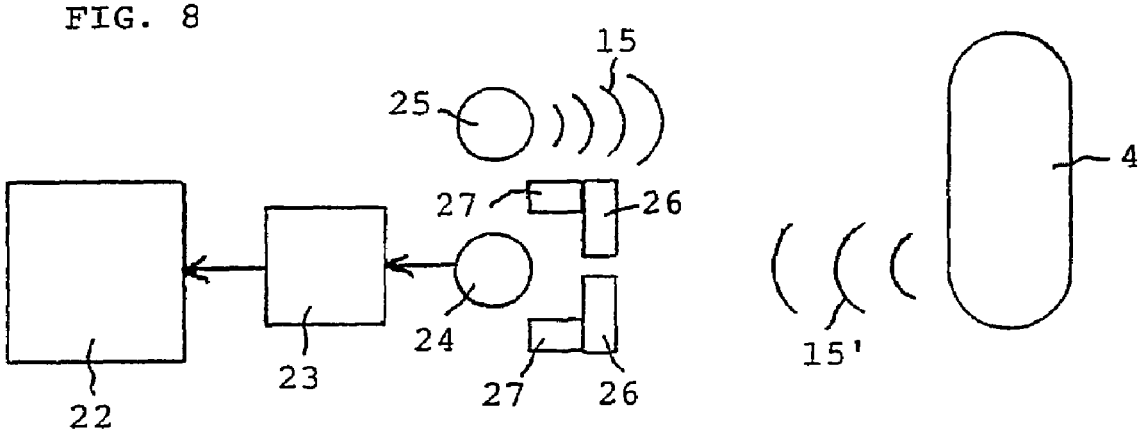
FIG. 8 is a schematic embodiment in connection with which sound waves are emitted and received.

The invention can also be used in case the object is recorded by means of other means, in particular by means of sound waves. FIG. 8 shows schematically a corresponding arrangement, whereby an object 4 is impinged by means of sound waves 15 of an acoustic source 25. Thereby, the sound waves can be in the audible range or e.g. in the ultrasonic range. A sound receiver 24 receives sound waves 15' reflected from the object 4 and an evaluation device 23, which optionally is coupled with a display device 22, produces an image of the object 4. Thereby, a relative movement between the object and a sound emitter and sound receiver also occurs in a known manner so that the entire object can be displayed. According to the invention, it is also provided an aperture 26 which opening is adjustable in its size according to the object size. In the Figure, adjusting means 27 are suggested. The recording of the object size of the object 4 for the adjustment of the aperture can thereby occur e.g. by means of separate sensors which are not shown in the Figure. At first, a pass by of the object 4 by means of the sound emitter and the sound transmitter can also occur without the aperture 26, whereby this pass by only serves for the recording of the dimensions of the object 4. After this, accordingly, the aperture 26 in front of the sound receiver 24 is adjusted and positioned and it occurs another line by line recording of the object 4 with the aperture 26 for a qualitative good display of the object. Accordingly, it can also be proceeded if the object is not recorded by means of the reflected sound but by means of such sound which goes through the object 4. Applications of the aperture in connection with the recording of the object with sound waves can be again in the medical field, in the testing of basic materials or echo-sounder recordings.

In the following, examples for radiograms with the aperture which is adjustable depending on the object are provided.

EXAMPLES

1. As an example of the design according to FIG. 1:

As a tripod, it serves a commercially available multi-tripod with film cassettes or storage foils. Subsequently, an aperture with a control system is incorporated into the tripod. In this way, the reduction of the scattered light can be calculated in a first approximation as a proportion which results from the entire irradiated area without aperture to the passage area of the aperture.

Calculation Example I

| | |
|---|---|
| Irradiated area without aperture: | 350 mm × 430 mm = 150500 mm2 |
| Passage area of the aperture: | 350 mm × 1 mm = 350 mm2 |
| Ratio to the aperture: | 430:1 or 0.2325% |

Without aperture 100% scattered radiation are generated; with aperture one achieves a reduction of the scattered radiation of 100%−0,2325%=99,7675%.

Calculation Example II

| | |
|---|---|
| Passage area of the aperture: | 175 mm × 0.01 mm = 1.75 mm2 |
| Ratio area of the aperture: | 86000:1 or 0.001163% |

By means of this aperture the scattered radiation is reduced by 100%−0,001163=99,9987%.

2. Number of passes and time need:

The number of passes is normally 1.

The time need for a linear movement in the direction A depends on the size of the object and practicably amounts between 0,1 and 10 seconds.

The invention claimed is:

1. A method for the recording of an object (4) by imaging by means of a radiation source (2) onto a recording means (3), whereby the object is x-rayed or illuminated and the object is recorded continuously or discontinuously line by line during the recording by means of at least one aperture (6) and a relative movement of the object on the one hand and recording means and optionally radiation source on the other hand, characterized in that a size of a focal opening (9, 19) in the aperture (6) in a direction of at least a dimension of the focal opening, which lies in the direction of the relative movement, is adjusted based on a previous measurement of at least one object size by a mechanical, ultrasonic or optical sensor detection device (8, 11).

2. The method according to claim 1, characterized in that the volume of the object, which is detected by a radiation field (5) of the radiation source (2), is used as object size.

3. The method according to claim 1, characterized in that the area of the object or a dimension of this area which is detected by a radiation field (5) of the radiation source (2) and which is opposite to the radiation field is used as the object size.

4. The method according to one of the claims 1 to 3, characterized in that the radiation field (5) is used as it exits the radiation source (2) or that the radiation field is limited by means of at least one collimator (2') in front of the aperture.

5. The method according to claim 1 characterized in that the object (4) and the recording means (3) are passed by the radiation source (2) which is stationary and the aperture (6) which is stationary, whereby the aperture (6) is arranged between the radiation source (2) and the object (4) or whereby the aperture (6) is arranged between the object (4) and the recording means.

6. The method-according to claim 1, characterized in that the radiation source (2) and the aperture (6) are passed by the object (4) which is stationary and the recording means (3) which is stationary, whereby the aperture (6) is arranged between the radiation source (2) and the object (4) or whereby the aperture (6) is arranged between the object (4) and the recording means (3) or whereby a first aperture (6) is arranged between the radiation source (2) and the object (4) and a second aperture (16) is arranged between the object (4) and the recording means (3).

7. The method according to claim 1, characterized in that the relative movement occurs in direction of breadth B of the objects and breadth b of the focal opening is adjusted depending on the object size.

8. The method according to claim 7 wherein the height h of the focal opening is adjusted.

9. The method according to claim 1, characterized in that the relative movement occurs in direction of a height of the object and height h of the focal opening is adjusted depending on the object height.

10. The method according to claim 1, characterized in that a thickness t of the aperture is additionally adjusted in dependency on the object thickness T.

11. The method according to claim 1, characterized in that the focal opening is adjusted depending on an output signal of a the detection device (8, 11) to the object size detection.

12. The method according to claim 1, characterized in that the focal opening dimension to the object dimension is adjusted in a range of 1:10 to 1:100,000.

13. A device for the recording of an object onto an recording means (3) by means of a radiation source (2), whereby the device comprises at least one aperture (6) and movement means for the relative movement between the aperture (6) and the object (4), an adjustment device (7, 11) for the adjustment of at least one focal opening dimension in the at least one aperture, and a mechanical, ultrasonic or optical sensor detection device (8, 11) for the detection of at least one object dimension, the adjustment device being connected with the detection device such that the at least one focal opening dimension is adjustable depending on the at least one detected object dimension, characterized in that the at least one adjustable focal opening dimension is adjustable, prior to or during each reading, in direction of the relative movement based on a previous measurement of at least one object dimension.

14. A device according to claim 13, characterized in that it comprises an X-ray source (2) which ray thereof is not collimated or limited by means of one collimator.

15. A device according to claim 13 or 14, characterized in that it comprises an object carrier (4') and that the object carrier on the one hand and the aperture (6) on the other hand are movable relative to each other by means of the adjustment means (7, 11).

16. A device according to claim 15, characterized in that the radiation source (2) and the aperture (6) are secured to the device and that for this, the object carrier (4') and the recording means (3) are movably arranged for the performance of the relative movement, whereby the aperture (6) is arranged between the radiation source (2) and the object carrier (4') or whereby the aperture (6) is arranged between the object carrier and the recording means (3).

17. A device according to claim 15, characterized in that the object carrier and the recording means (3) are secured to the device and that for this, the radiation source (2) and the aperture (6) are movably arranged for the performance of the relative movement, whereby the aperture (6) is arranged between the radiation source (2) and the object carrier and the recording means (3) or whereby the aperture (6) is arranged between the object carrier and the recording means (3) or whereby a first aperture (6) is arranged between the radiation source (2) and the object carrier and a second aperture (16) is arranged between the object carrier and the recording means which is motion-coupled with the first aperture.

18. A device according to claim 13, wherein the radiation source (2) is of an X-ray radiation source and wherein a radiation field of the X-ray source (2) is collimated by a collimator (2') and further comprises an object carrier (4') and the object carrier on the one hand and the aperture (6) on the other hand are movable relative to each other by means of the adjustment means (7, 11).

19. A device according to claim 13, wherein the radiation source (2) is an X-ray radiation source and wherein the focal opening dimension to the object dimension is adjusted in a range of 1:10 to 1:100,000, and further comprises an object carrier (4') and the object carrier on the one hand and the aperture (6) on the other hand are movable relative to each other by means of the adjustment means (7, 11).

* * * * *